US006394166B2

(12) United States Patent
Hubbard et al.

(10) Patent No.: US 6,394,166 B2
(45) Date of Patent: May 28, 2002

(54) APPARATUS FOR APPLYING TPO ADHESIVE TO A SINGLE-PLY ROOFING MEMBRANE

(75) Inventors: Michael J. Hubbard, Holland; Walter J. Kelly, Wadsworth; Anthony Verrocchi, Akron; Raymond J. Weinert, Macedonia, all of OH (US)

(73) Assignee: Omnova Soltuions Inc., Fairlawn, OH (US)

( * ) Notice: Subject to any disclaimer, the term of this patent is extended or adjusted under 35 U.S.C. 154(b) by 0 days.

(21) Appl. No.: 09/735,259

(22) Filed: Dec. 12, 2000

Related U.S. Application Data

(63) Continuation of application No. 09/196,850, filed on Nov. 20, 1998, now Pat. No. 6,253,528.

(51) Int. Cl.[7] ..... E04D 15/07

(52) U.S. Cl. ..... 156/575; 156/578; 52/749.12; 222/146.5; 222/413

(58) Field of Search ..... 156/575, 578, 156/71; 52/746.11, 749.12, 746.1; 222/413, 146.5

(56) References Cited

U.S. PATENT DOCUMENTS 4,087,309 A * 5/1978 Lang ..... 156/578
4,629,094 A * 12/1986 Vogel et al. ..... 222/413
4,725,328 A * 2/1988 Arnold ..... 52/746.11
5,110,398 A * 5/1992 Murphy ..... 156/575

* cited by examiner

*Primary Examiner*—Michael Safavi
(74) *Attorney, Agent, or Firm*—Robert F. Rywalski; Larry R. Meenan

(57) ABSTRACT

An apparatus and method of applying a bead of TPO or TPE adhesive between a talc-free first roofing membrane and an overlapping talc-free second roofing membrane. The apparatus includes a movably supported chassis and an extruder attached to the chassis having a nozzle including an outlet having at least one opening for applying the TPO or TPE adhesive between the first membrane and the overlapping second membrane to adhere the overlapping second membrane to the first membrane. The TPO or TPE adhesive is heated within the apparatus allowing application along the seam between the first and second membranes. The outlet of the nozzle is positioned between the first and second membranes with the TPO or TPE adhesive applied between the overlapping portions of the membranes while pressing the overlapping first and second membranes to hold the overlapping portions together.

17 Claims, 2 Drawing Sheets

APPARATUS FOR APPLYING TPO ADHESIVE TO A SINGLE-PLY ROOFING MEMBRANE

This application is a continuation of U.S. patent application Ser. No. 09/196,850, entitled Apparatus For Applying TPO Adhesive To A Single-Ply Roofing Membrane, filed Nov. 20, 1998, now U.S. Pat. No. 6,253,528 the disclosure of which is hereby incorporated by reference in its entirety.

FIELD OF THE INVENTION

This invention relates to an apparatus for applying TPO or TPE based solid phase adhesive to a single-ply roofing membrane. More particularly, this invention relates to an apparatus for applying the adhesive layer between overlapping talc-free roofing membranes of a membrane roofing system to form a seam and a method of using the same.

BACKGROUND OF THE INVENTION

A roof system generally includes a roof deck that is considered the structural supporting surface of a building extending between surrounding exterior walls of the building. The roof deck may be constructed from plywood, metal decking or concrete or any other suitable material. Depending upon the construction, the roof deck may extend over the surrounding exterior walls or the roof deck may stop short of the exterior walls thereby forming a parapet wall, i.e., a low retaining wall at the edge of the roof deck. If desired, the roofing system may also include an insulation barrier formed from polyisocyanurate or any other suitable material applied over the roof deck.

To make the roof system weather resistant, a single-ply membrane roof may be installed over the roof deck. A single-ply membrane roof refers to a water impermeable single sheet of polymeric material such as thermoplastic olefins, chlorinated polyethylene, polyvinyl chloride, chlorosulfonated polyethylene or ethylene propylene diene rubber (EPDM). The membrane roof may be mechanically fastened over the roof deck using a variety of different methods well known in the art.

When applying the membrane roof to the roof deck, it is usually necessary to splice together roofing membranes to form a single continuous field of the membrane roof An example of this would be cured EPDM sheets. It will be appreciated that the splice or seam area is subjected to both short term and long term stresses such as those caused by roof movement, heavy winds, freeze thaw cycling and thermal cycling. Such stresses may manifest themselves in shear forces or peel forces, i.e., the seam peels back under severe stress conditions or may cause a partially open seam under less severe conditions.

In view of the foregoing problem, it has been necessary to apply an adhesive to splice the cured EPDM roofing membranes together. The adhesive for splicing cured EPDM roofing membranes together must be capable of being simply and/or economically applied in the field to provide an acceptable adhesive bond. The applied adhesive must provide sufficient seam peel and shear strength such that the spliced EPDM roofing membranes resist both the short term and long term stresses. Moreover, the applied adhesive must be resistant to oxidation, hydrolysis and chemical attack from pooled water.

In accordance with one object of the present invention, an apparatus is provided for continuously applying TPO or T.PE adhesive between talc-free overlapping edges of roofing membranes (e.g. EPDM sheets). In accordance with another object of the present invention, an apparatus is provided for continuously applying a TPO (thermoplastic olefin) or TPE (thermoplastic elastomer) adhesive between overlapping edges of EPDM roofing membranes. It is another object of the present invention to provide an applicator for applying a TPQ or TPE adhesive between overlapping single-ply EPDM roof membranes to form a seam in the field. Yet another object of the present invention is to provide an applicator and method for applying a TPO or TPE adhesive that is simple to use and economical to manufacture.

SUMMARY OF THE INVENTION

Briefly, the present invention relates to an apparatus capable of applying a TPO or TPE adhesive between a talc-free first membrane and an overlapping talc-free second membrane. The apparatus includes a movably supported chassis and an extruder attached to the chassis having a nozzle including an outlet having at least one opening for applying the TPO or TPE adhesive between the first membrane and the overlapping second membrane to adhere the overlapping second membrane to the first membrane.

BRIEF DESCRIPTION OF THE DRAWINGS

Further features and other objects and advantages of this invention will become clear from the following detailed description made with reference to the drawings in which.

DETAILED DESCRIPTION OF THE PREFERRED EMBODIMENTS

Figure 1:
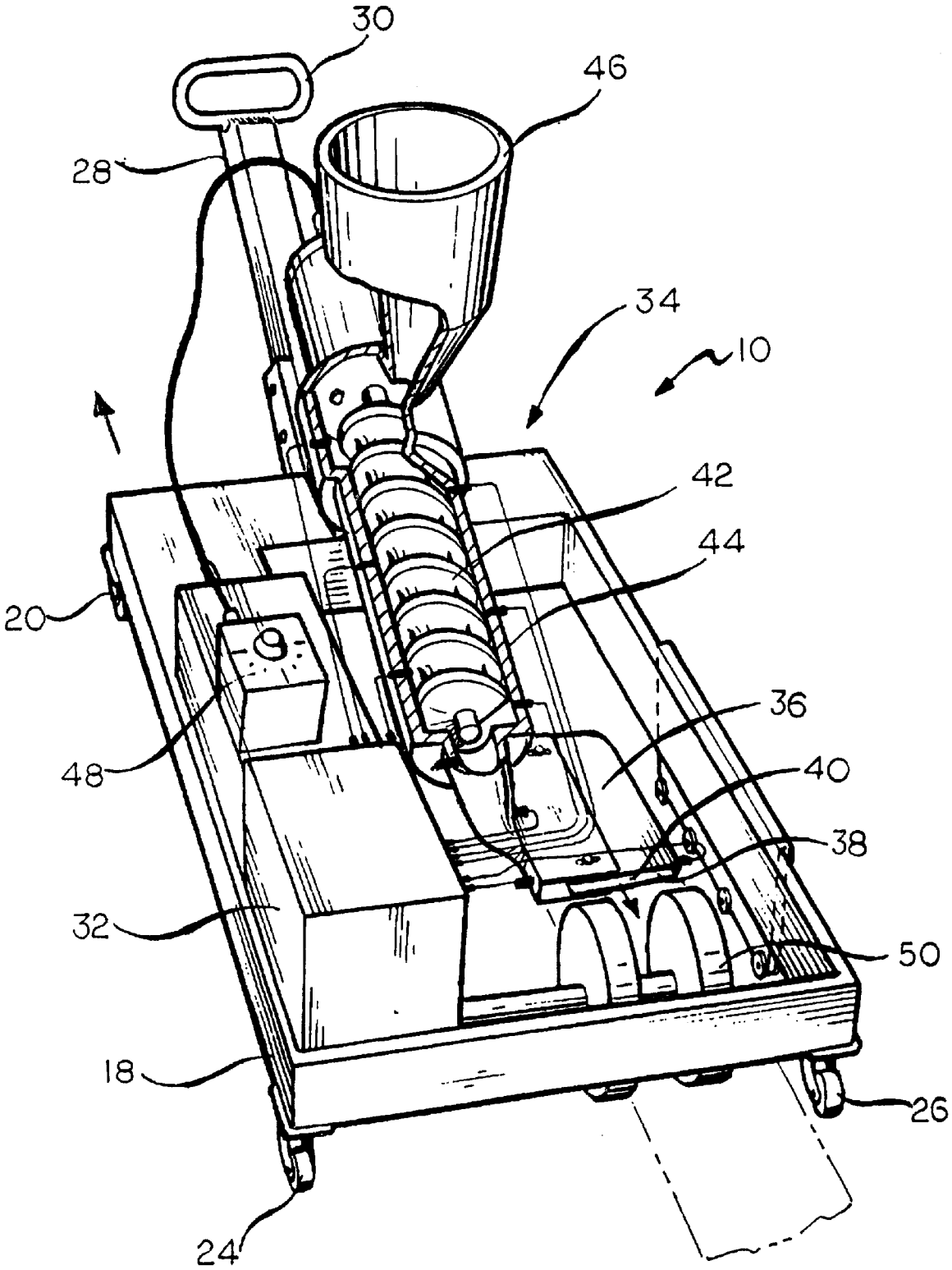
FIG. 1 is a perspective view of one embodiment of a TPO or TPE hot melt applicator.
Figure 2:
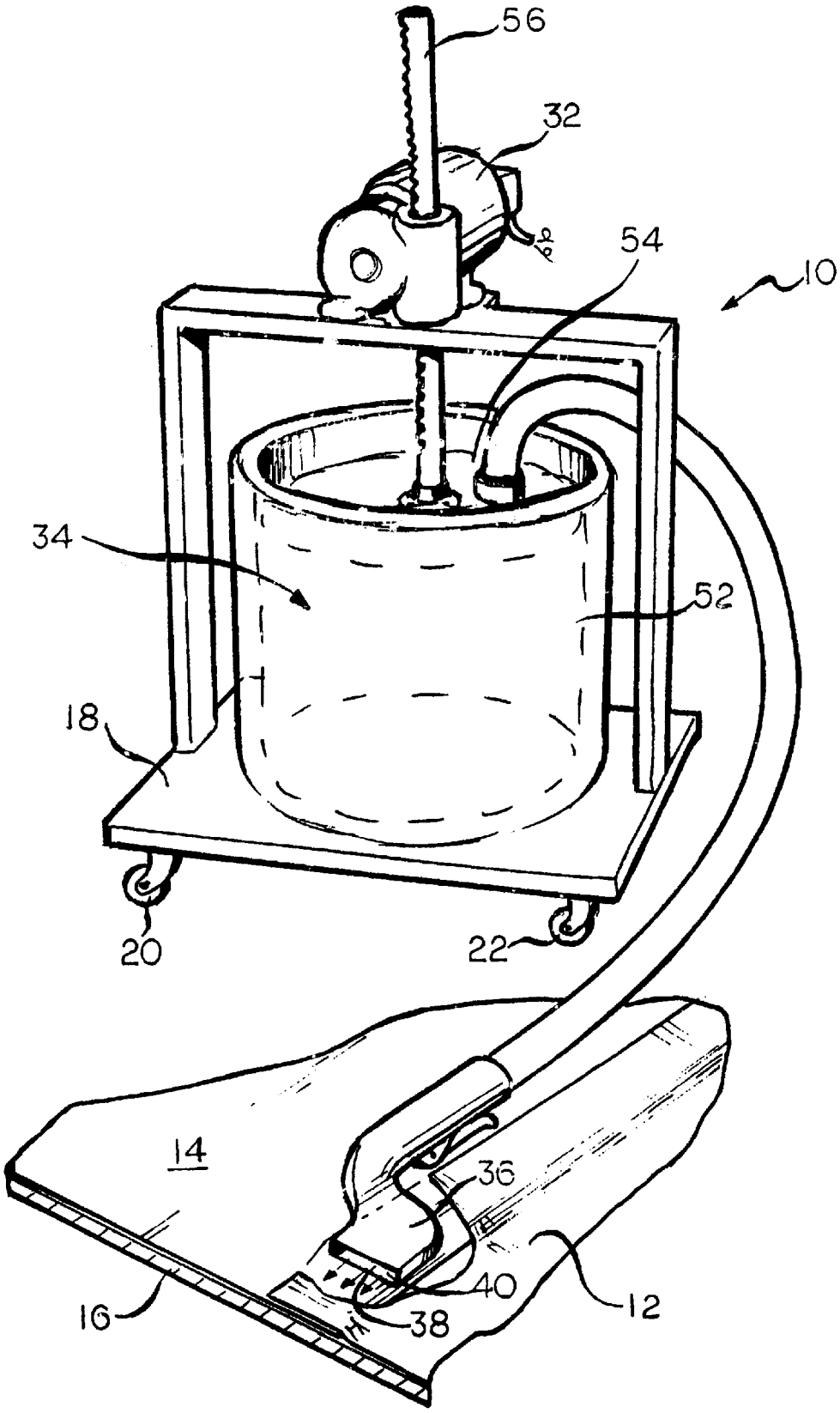
FIG. 2 is a perspective view of another embodiment of a TPO or TPE hot melt applicator.

In the following description, like reference characters designate like or corresponding parts. Also in the following description, it is to be understood that such terms as "forward", "rearward", and the like, are words of convenience and are not to be construed as limiting terms apart from the invention as claimed. The present invention is directed to an applicator 10 for applying TPO or TPE adhesive between overlapping first and second membranes 12 and 14 to form a continuous sheet of a single-ply membrane that may be installed over a roof deck 16 or other roofing structure.

As used herein, "TPO" refers to adhesive formed of ethylene propylene rubber blended with polypropylene and TPE refers to a thermoplastic elastomer consisting of a highly crosslinked rubbery polymer in combination with a thermoplastic polymer. The crosslinked rubbery phase may be a polymer comprised of ethylene-propylene-diene termonomer and the thermoplastic polymer may be a polyolefin. In addition, the first membrane 12 and the second membrane 14 refer to water impermeable single-ply sheets of ethylene propylene diene terpolymer (EPDM). An important aspect of the present invention is that the roofing membranes of EPDM are "clean" sheets, i.e.; the sheets do not include talc or other treatments typically applied thereto in well known manufacturing operations of EPDM roofing membranes. The roofing membranes may be of any suitable length and width as desired subject to manufacturing and performance considerations. For a more detailed description of the manufacturing process of EPDM roofing membranes, reference is made to U.S. Pat. Nos. 4,337,112 and 4,343,667, incorporated herein by reference.

Referring to the figures, the apparatus 10 includes a chassis 18 that is movably supported by wheels. In a preferred embodiment, the chassis 18 is movably supported by a set of two spaced rear wheels 20 and 22 and a set of two spaced forward wheels 24 and 26. The rear wheels 20 and 22 and forward wheels 24 and 26 are mounted to the underside of the chassis 18 adjacent to each corner of the chassis using most any suitable means well known in the art. The chassis 18 is preferably of a one-piece frame member construction. The frame member may be formed of most any suitable material such as cast aluminum and the like.

Referring to FIG. 1, extending generally upward from the chassis 18 is a guide handle 28 at the end of which is a grip 30. In a preferred embodiment, the guide handle 28 is an aluminum rod and is mounted to a threaded boss on the chassis 18. The chassis 18 may be motor driven by a heavy duty electrical motor 32 of a type well known in the art. The motor 32 drives at least one wheel for movably transporting the chassis 18. The motor 32 is operatively coupled to at least one of the wheels through a gear transmission that is selectively engaged or disengaged with a drive axle by a transmission lever. The motor 32, thus, operates to drive at least one of the wheels and to move the apparatus 10 in the forward direction. As the apparatus 10 moves forward, it is guided by manipulation of the guide handle 28.

Attached to the chassis 18 is an extruder 34 for continuously extruding the TPO or TPE adhesive. The extruder 34 is operatively connected to a nozzle 36 including an outlet 38 having at least one rectangular opening 40 to apply a thin wide bead of adhesive for selective distribution of the TPO or TPE adhesive between the overlapping membranes 12 and 14.

In one embodiment, the extruder 34 includes a helical screw 42. The helical screw 42 is enclosed within a housing 44 that is heated by electrical resistance to melt the TPQ or TPE adhesive to a desired temperature. The housing 44 is inclined at an angle and attached to a feed bin 46 wherein TPO or TPE adhesive is fed and metered through the housing to the nozzle 36. A control panel 48 is mounted to the chassis 18 for adjusting the speed and temperature of the apparatus 10. For example, the temperature of the housing, as produced by the heating element may be controlled by a thermostat, rheostat, or a potentiometer and the like operatively connected to a control knob of the control panel 48.

In a preferred embodiment, as shown in FIG. 1, the apparatus 10 may also include a press wheel 50. Depending upon the application conditions, the press wheel 50 may be bifurcated or the press wheel may be formed as a single wheel. It will be appreciated that the press wheel 50 may be bifurcated to allow a roof membrane fastener of a type well known in the art to pass between the press wheel and to simultaneously press the first membrane 12 and the second membrane 14 against the roof deck 16 on both sides of the roof membrane fastener. The press wheel 50 is located rearward of the nozzle 36 relative to the direction of movement of the apparatus 10 and in front of the outlet 38 of the nozzle to press the first membrane 12 and the second membrane 14 firmly against the roof deck 16 and against each other after the adhesive has been applied. As a further aid in maintaining as much pressure on the roof membranes 12 and 14 as possible, one or more weights may be affixed to the chassis over the press wheel 50. The press wheel 50 may be rotatable on a single axle operatively attached to the chassis 18 or rotatable on separate axles operatively attached to the chassis.

In yet another embodiment, the extruder 34 includes an open-end housing 52 having an actuatable piston member 54. The piston member 54 is sized to match the internal diameter of the open-end of the housing 52 and movable axially within the housing. The piston member 54 includes a heated plunger or platen to melt the polymer. In an alternate embodiment, the entire reservoir and hose can be heated to melt the polymer. The plunger or platen is attached to the piston member 54 and forces the melted adhesive through a heater hose and between the sheets forming the seam. The thickness of the applied adhesive layer should be about 0.1 to 30 mils, preferably about 2 to 10 mils. The width of the adhesive should be sufficient to provide dimensional stability to the overlapped sheets.

Attached to the top surface of the piston member 54 is a notched bar 56. The notched bar 56 is operatively attached to a motor 32 as well known in the art to incrementally force the piston member downward within the housing 52 thereby forcing the TPO or TPE adhesive Out of the housing and through the flexible hose to the nozzle 36.

The apparatus contains a heated moveable plunger or platen to melt the polymer. The plunger or platen is attached to the piston and forces the molten adhesive through a heated hose and it is dispensed in the area between the sheets forming a seam. The thickness of the final adhesive layer should be about 0.1 to 30 mils, more preferred is 2 to 10 mils. The width of the adhesive should be sufficient to provide dimensional stability to the overlapped sheets. Alternatively, the entire reservoir and hose can be heated to melt the polymer.

The first membrane 12 is typically placed on the roof deck 16 first. It will be appreciated that the first membrane 12 may have at least one roof membrane fastener 18 secured through the first membrane and to the roof deck to mechanically fasten the membrane to the roof deck. The roof membrane fastener 18 may be of most any suitable size and type depending upon membrane roof system performance requirements. For example, the roof membrane fastener 18 may be of a type well known in the art such as a batten bar or seam disc size and the like and may vary from about 1 inch to about 4 inches or more in width. The second membrane 14 is then positioned in overlapping relation over a portion of a marginal edge of the first membrane 12. After the first and second membranes 12 and 14 have been laid in an overlapping relation, the nozzle 36 of the apparatus 10 is inserted between the first and second membranes 12 and 14. The nozzle 36 is then conveyed along and between the first and second membranes 12 and 14. The nozzle 36 applies a thin, wide bead of TPO or TPE adhesive through the outlet 38 to adhere the overlapping portions of the first and second membranes 12 and 14 together. It will be appreciated that one may control the amount of adhesive being applied to the membranes 12 and 14 by adjusting the speed of rotation of the screw 42 or amount of pressure applied by the piston 54.

The patents and documents described herein are hereby incorporated by reference.

Having described presently preferred embodiments of the invention, it is to be understood that it may be otherwise embodied within the scope of the appended claims.

What is claimed is:

1. An apparatus capable of applying a TPO or TPE adhesive between a talc-free first membrane and an overlapping talc-free second membrane, the apparatus comprising:

a movably supported chassis; and an extruder attached to said chassis, the extruder including a helical screw enclosed within an inclined heated housing to melt the TPO or TPE adhesive, the housing attached to a feed bin wherein TPO or TPE adhesive is fed and metered through the housing to a nozzle including an outlet having at least one rectangular opening for applying a thin wide bead of heated TPO or TPE adhesive between the first membrane and the overlapping second membrane to adhere the overlapping second membrane to the first membrane.

2. The apparatus of claim 1 further comprising a press wheel rotatably attached to said chassis and located rearward of said nozzle relative to the direction of movement of the apparatus and capable of simultaneously applying pressure to the second membrane.

3. The apparatus of claim 2 wherein the press wheel is bifurcated.

4. The apparatus of claim 3 wherein each portion of the bifurcated press wheel is rotatable on a separate axle attached to the chassis.

5. The apparatus of claim 3 wherein the press wheel is rotatable on a single axle attached to said chassis.

6. The apparatus of claim 1 wherein the TPO is an adhesive formed of ethylene propylene rubber blended with polypropylene.

7. The apparatus of claim 1 wherein the TPE is a thermoplastic elastomer consisting of a highly crosslinked rubbery polymer in combination with a thermoplastic polymer.

8. The apparatus of claim 7 wherein the crosslinked rubbery phase is a polymer comprised of ethylene-propylene-diene termonomer and the thermoplastic polymer is a polyolefin.

9. An apparatus capable of applying a TPO or TPE adhesive between a talc-free first membrane and an overlapping talc-free second membrane, the apparatus comprising:

a movably supported chassis; and an extruder attached to said chassis, the extruder having a nozzle including an outlet having at least one opening for applying TPO or TPE adhesive between the first membrane and the overlapping second membrane to adhere the overlapping second membrane to the first membrane, wherein the extruder includes an open-end housing having an actuable piston member and a flexible hose, the piston member including a heated platen to melt the adhesive whereby the actuable piston member forces the melted adhesive through the flexible hose between the first membrane and the overlapping second membrane.

10. The apparatus of claim 9 wherein the open-end housing is heated.

11. The apparatus of claim 9 wherein the TPO is an adhesive formed of ethylene propylene rubber blended with polypropylene.

12. The process of claim 9 wherein the TPE is a thermoplastic elastomer consisting of a highly crosslinked rubbery polymer in combination with a thermoplastic polymer.

13. The process of claim 9 wherein the crosslinked rubbery phase is a polymer comprised of ethylene-propylene-diene termonomer and the thermoplastic polymer is a polyolefin.

14. An apparatus capable of applying a TPO or TPE adhesive between a talc-free first membrane and an overlapping talc-free second membrane, the apparatus comprising:

a movably supported chassis; and an extruder attached to said chassis having a nozzle including an outlet having at least one opening for applying TPO or TPE adhesive between the first membrane and the overlapping second membrane to adhere the overlapping second membrane to the first membrane, wherein the extruder includes a heated open-end housing having a flexible hose and an actuable piston member including a platen, whereby the actuable piston member forces the melted adhesive through the flexible hose between the first membrane and the overlapping second membrane.

15. The apparatus of claim 14 wherein the TPO is an adhesive formed of ethylene propylene rubber blended with polypropylene.

16. The process of claim 14 wherein the TPE is a thermoplastic elastomer consisting of a highly crosslinked rubbery polymer in combination with a thermoplastic polymer.

17. The process of claim 14 wherein the crosslinked rubbery phase is a polymer comprised of etylene-propylene-diene termonomer and the thermoplastic polymer is a polyolefin.

* * * * *